US009111704B2

(12) United States Patent
Wang et al.

(10) Patent No.: US 9,111,704 B2
(45) Date of Patent: Aug. 18, 2015

(54) ROTARY PADDLE LEVEL SWITCH

(71) Applicant: Finetek Co., Ltd., New Taipei (TW)

(72) Inventors: Chih-Wen Wang, New Taipei (TW); Ching-Jui Chen, New Taipei (TW); Cheng-Tao Lee, New Taipei (TW); Ting-Kuo Wu, New Taipei (TW); Chao-Kai Cheng, New Taipei (TW)

(73) Assignee: Finetek Co., Ltd., New Taipei (TW)

( * ) Notice: Subject to any disclaimer, the term of this patent is extended or adjusted under 35 U.S.C. 154(b) by 137 days.

(21) Appl. No.: 14/031,249

(22) Filed: Sep. 19, 2013

(65) Prior Publication Data

US 2015/0077954 A1 Mar. 19, 2015

(51) Int. Cl.

| | |
|---|---|
| ***H01H 3/16*** | (2006.01) |
| ***H01H 3/18*** | (2006.01) |
| ***H01H 15/14*** | (2006.01) |
| ***H01H 17/12*** | (2006.01) |
| ***H01H 19/18*** | (2006.01) |
| ***H01H 21/28*** | (2006.01) |
| ***H01H 35/00*** | (2006.01) |

(52) U.S. Cl.

CPC . *H01H 35/00* (2013.01); *H01H 3/16* (2013.01)

(58) Field of Classification Search

CPC ..... H01H 3/16; H01H 3/18; H01H 15/14; H01H 17/12; H01H 19/18; H01H 21/28; H01H 1/12; H01H 1/16; H01H 3/00; H01H 3/02; H01H 3/08; H01H 3/10; H01H 3/30; H01H 3/32; H01H 3/38; H01H 13/20; H01H 13/50; H01H 19/00; H01H 19/14; H01H 19/16; H01H 19/28; H01H 19/54; H01H 19/60; H01H 35/24; H01H 2003/00; H01H 2003/02; H01H 2003/08; H01H 2003/10; H01H 2003/3084; H01H 2003/032; H01H 2019/00; H01H 2025/00; H01H 2221/00; H01H 2221/008; H01H 2221/01; H01H 2221/024; H01H 2221/08; H01H 2231/038; H01H 2231/048; G01F 23/226; G01F 23/32; F27D 2021/0042; F27D 21/00; B01J 8/082

USPC ..... 200/47; 340/617, 686.3, 615

See application file for complete search history.

(56) References Cited

U.S. PATENT DOCUMENTS

| | | | | |
|---|---|---|---|---|
| 3,818,159 | A * | 6/1974 | Evans et al. | 200/61.21 |
| 3,941,956 | A * | 3/1976 | Delin et al. | 200/61.2 |
| 4,551,663 | A * | 11/1985 | Gruber | 318/482 |

* cited by examiner

*Primary Examiner* — Edwin A. Leon
*Assistant Examiner* — Anthony R. Jimenez
(74) *Attorney, Agent, or Firm* — C. G. Mersereau; Nikolai & Mersereau, P.A.

(57) ABSTRACT

A rotary paddle level switch has a housing, a driving unit, two switches, a resilient member, a clutch, a transmission shaft, and a propeller. A resilient clip of the clutch holds a non-circular actuation section of the transmission shaft. When the driving unit drives the clutch to rotate, the transmission shaft and the propeller are driven by the clutch. When the propeller is rapidly rotated by suddenly exerting an excessively large external force thereon, as the resilient clip holds the transmission shaft by elastic force, the fast rotating transmission shaft removes itself from the holding of the resilient clip and is rotated without driving the resilient clip to rotate, thereby avoiding the transmission of the external force and damage to the driving unit. As the clutch just needs a clutch stand and a resilient clip to achieve the foregoing function, the level switch is structurally simple and relatively inexpensive.

20 Claims, 11 Drawing Sheets

ROTARY PADDLE LEVEL SWITCH

BACKGROUND OF THE INVENTION

1. Field of the Invention

The present invention relates to a level switch, and more particularly to a rotary paddle level switch applied to detect material level of warehouse.

2. Description of the Related Art

Level switches are applicable to material management of warehouse, and serve to monitor the availability of material in warehouse or to detect the level of material stored in warehouse. The material in a warehouse may be any kind of material with a constant specific weight, such as, animal feed, grain, peanut, malt, clay, sand, limestone, rock, sawdust, lumber, metal, rubber, resin, plastic pellet, regrinding plastic, coal, cast material, and the like. Level switches can be classified as rotary paddle level switches, vibrating fork level switches, and capacitive level switches according to design concepts of the level switches.

A conventional rotary paddle level switch has a housing, a driving unit, a first switch, a second switch, a torque spring, a transmission shaft, and a propeller. The driving unit is pivotally mounted inside the housing, and has a pressing rod mounted away an axial direction and extending in an eccentric direction. The two switches are mounted inside the housing. One end of the torque spring abuts against an inner wall of the housing, and the other end of the torque spring pushes against the pressing rod such that the pressing rod abuts against the first switch. The transmission shaft is driven by the driving unit, and protrudes beyond the housing. The propeller is mounted on an external end of the transmission shaft.

When the conventional rotary paddle level switch is mounted in a warehouse and is operated, the driving unit drives the transmission shaft to rotate the propeller. When the level of a stored material rises up to reach the propeller, the propeller and the transmission shaft stop rotating because of the resistance caused by the material, and the driving unit compresses the torque spring to reversely rotate the transmission shaft. The pressing rod of the driving unit then departs from the first switch and abuts against the second switch instead. The driving unit stops rotating the transmission shaft after the pressing rod no longer abuts against the first switch. The second switch signals that the material has been accumulated to a designated level after being abutted, so as to achieve the objective of monitoring the level of a material stored in a warehouse.

However, the conventional rotary paddle level switch has the following shortcomings.

Firstly, during the course of dropping a material in a warehouse, the material may hit the propeller from a specific angle to abruptly rotate the propeller at a high speed. Rotating at a high speed, the parts of the driving unit, such as transmission gears, are prone to damage. A clutch is therefore mounted between the transmission shaft and the driving unit. When the propeller and the transmission shaft are subject to an excessively large external force, the clutch disconnects the transmission shaft from the driving unit to prevent the driving unit from being damaged. However, the conventional clutch is structurally complicated, and the production cost of the clutch is relatively high.

Secondly, when the propeller hits the accumulated material and generates a resistance force, the resistance force generates a torque that is indirectly exerted on the torque spring. However, the sensitivity and accuracy of the torque spring are not as satisfactory as expected, early or late deactivation of the driving unit.

SUMMARY OF THE INVENTION

An objective of the present invention is to provide a rotary paddle level switch being structurally simple and less costly.

To achieve the foregoing objective, the A rotary paddle level switch has a housing, a circuit board, a first switch, a second switch, a resilient member, a clutch, and a propeller.

The circuit board is mounted inside the housing.

The driving unit is rotatably mounted inside the housing, is electrically connected to the circuit board, and has a pressing member and an output member. The pressing member and the output member are not co-axial. The pressing member is mounted on a bottom of the driving unit. The output member is rotatably mounted in the driving unit and protrudes downwards.

The first switch is mounted inside the housing and is electrically connected to the circuit board.

The second switch is mounted inside the housing, is electrically connected to the circuit board, and is spaced apart from the first switch by a gap.

The resilient member is mounted inside the housing, and pulls the driving unit for the pressing member of the driving unit to abut against the first switch.

The transmission shaft is mounted in the housing, has an actuation section formed on a top end of the transmission shaft, and has a non-circular section. A bottom end of the transmission shaft protrudes downward beyond the housing.

The clutch is mounted inside the housing, is connected between the driving unit and the transmission shaft, is driven by the driving unit to rotate, and has a clutch stand and a resilient clip.

The clutch stand is non-relatively rotationally coupled to the output member of the driving unit, and sleeves the actuation section of the transmission shaft.

The resilient clip is mounted inside the clutch stand, clips the actuation section of the transmission shaft, and is selectively opened by the actuation section.

The propeller is mounted on the transmission shaft, and is located outside the housing.

The present invention is advantageous in that the resilient clip of the clutch holds the non-circular actuation section of the transmission shaft and the clutch is rotatable with the transmission shaft and the propeller when the driving unit drives the clutch to rotate during a regular operating condition, and the transmission removes itself from the holding of resilient clip and is rotated alone without driving the resilient clip to rotate when the propeller is suddenly subject to an excessively large external force and all of a sudden the external force drives the transmission shaft to rapidly rotate, so as to avoid the transmission of the external force and damage to the driving unit. The clutch only has a clutch stand and a resilient clip to achieve the foregoing effectiveness, and is therefore structurally simple and relatively cost-effective.

Additionally, the resilient member is a tension spring, which has higher sensitivity and torque accuracy. Accordingly, the resilient spring allows the driving unit to accurately resist the torque and moves the pressing member at a right timing. The rotary paddle level switch further has a light-emitting unit connected to the housing and electrically connected to the circuit board. When a material is accumulated up to a designated level, the second switch is triggered, and the light-emitting unit simultaneously emits light to be visible to users.

Other objectives, advantages and novel features of the invention will become more apparent from the following detailed description when taken in conjunction with the accompanying drawings.

DETAILED DESCRIPTION OF THE INVENTION

Figure 1:
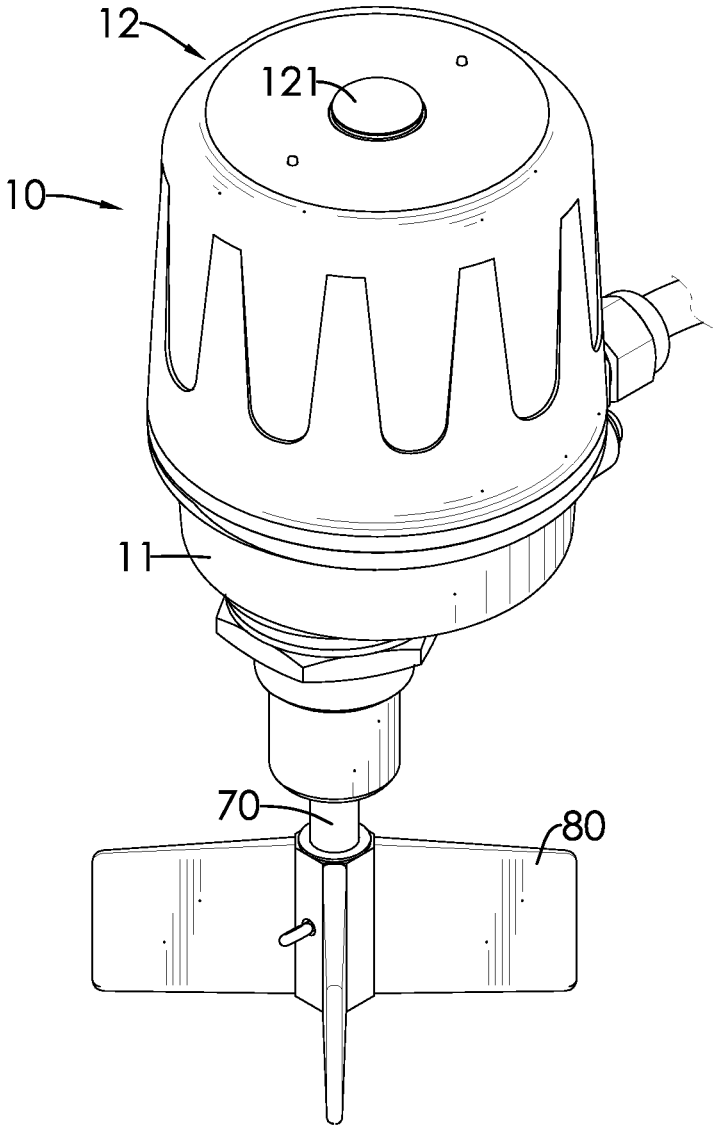
FIG. 1 is a perspective view of a rotary paddle level switch.
Figure 2:
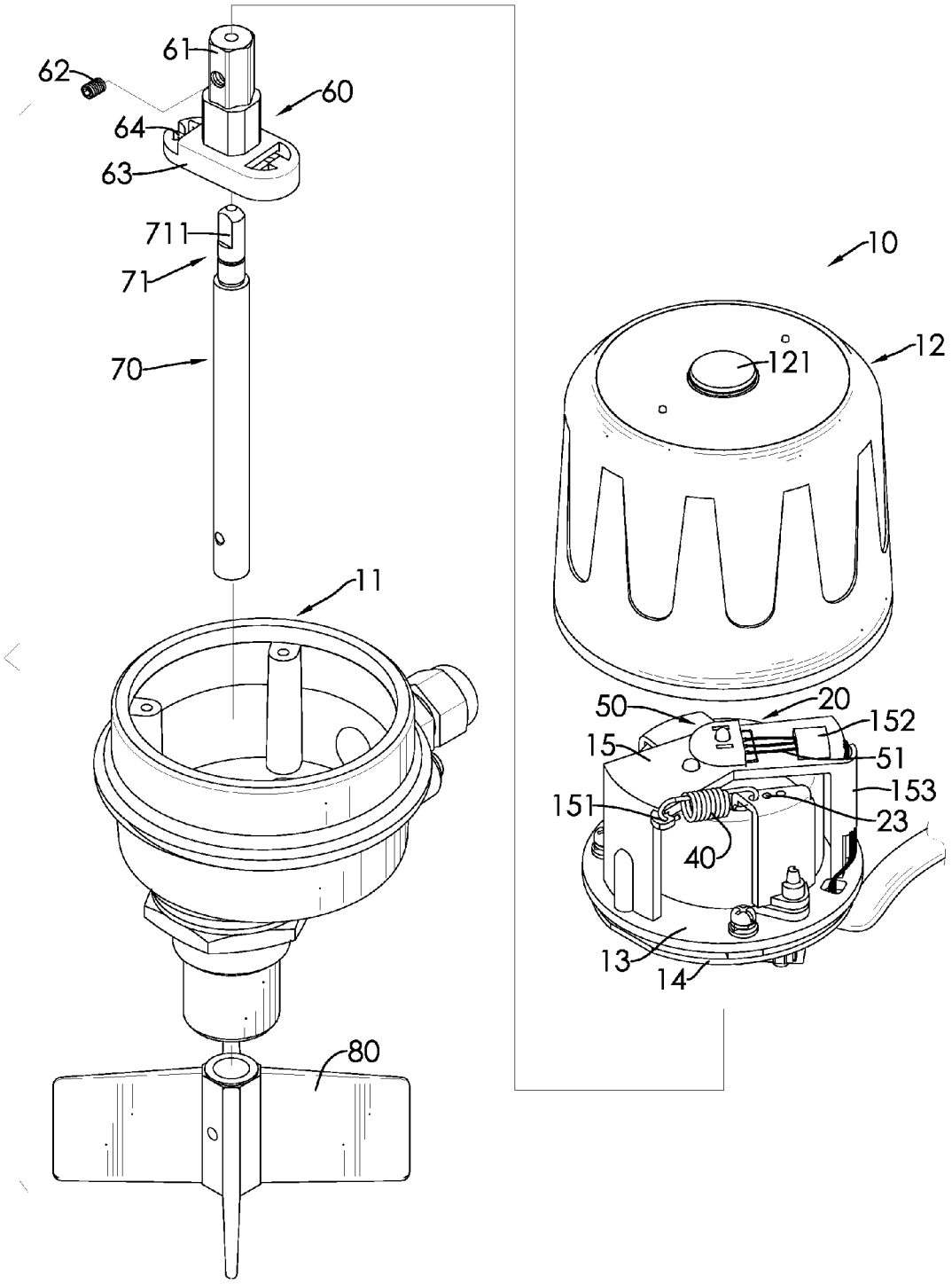
FIG. 2 is a partially exploded perspective view of the rotary paddle level switch in FIG. 1.
Figure 3:
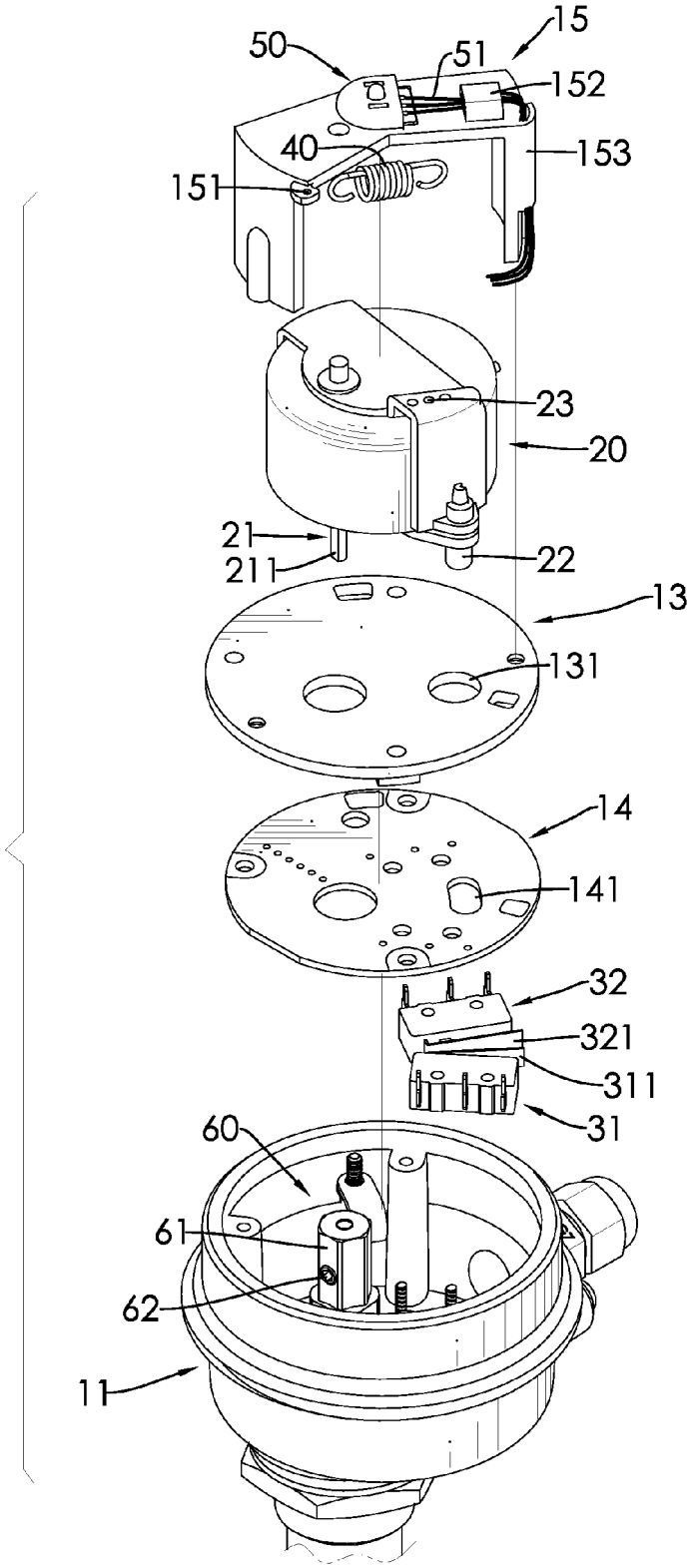
FIG. 3 is another partially exploded perspective view of the rotary paddle level switch in FIG. 1.

With reference to FIGS. 1 to 3, a rotary paddle level switch in accordance with the present invention has a housing 10, a circuit board 14, a driving unit 20, a first switch 31, a second switch 32, a resilient member 40, a light-emitting unit 50, a clutch 60, a transmission shaft 70, and a propeller 80.

With reference to FIGS. 2 to 5, the housing 10 has a bottom base 11, a top cover 12, a support board 13, and a mounting desk 15. The bottom base 11 and the top cover 12 are combined to define a chamber therein. The top cover 12 has a light-transmitting portion 121 mounted on a top of the top cover 12. The support board 13 is securely mounted inside the bottom base 11, and has a first track hole 131. The first track hole 131 is formed through the support board 13, and is a round hole. The mounting desk 15 is mounted on a top of the support board 13, and has an insertion hole 151 and at least one wire track 152, 153. The insertion hole 151 is formed in a top surface of the mounting desk 15. The at least one wire track 152, 153 is formed on the top surface and a side surface of the mounting desk 15.

The circuit board 14 is mounted inside the housing 10, is mounted on a bottom of the support board 13, and a second track hole 141. The second track hole 141 is formed through the support board 13, and is a curved hole. The second track hole 141 is located underneath the first track hole 131 of the support board 13.

Figure 4:
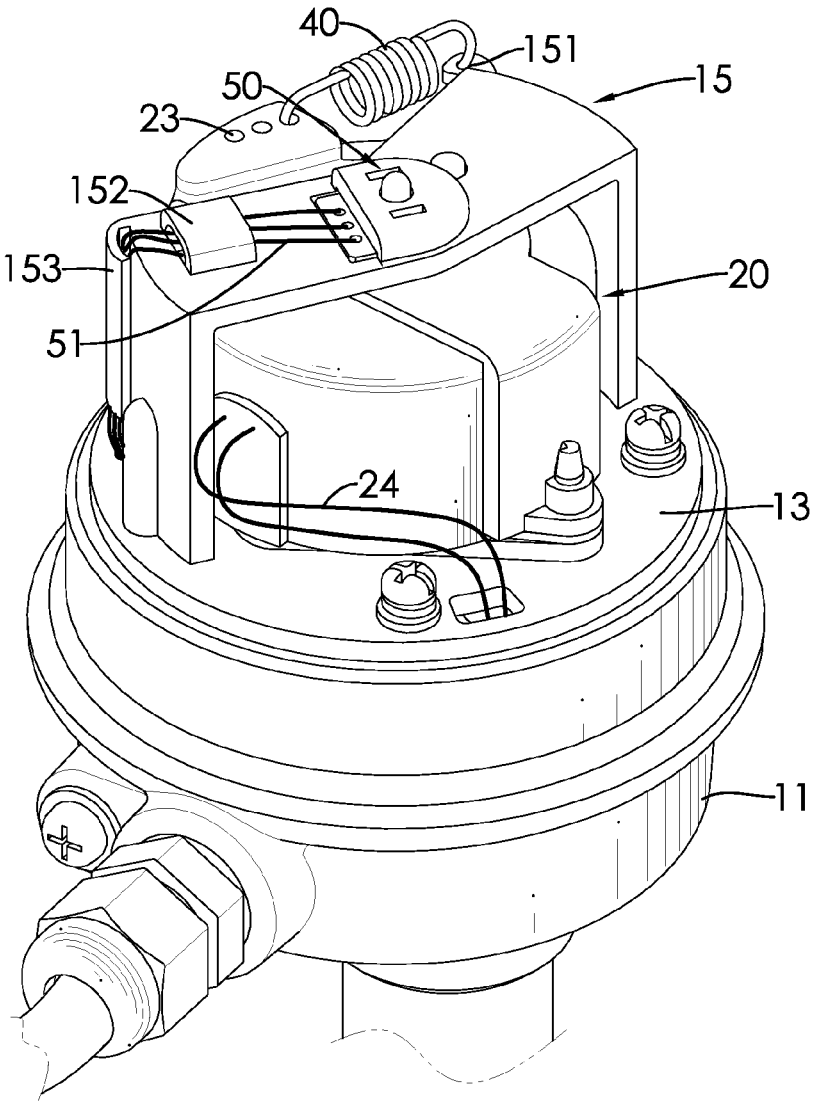
FIG. 4 is a partially enlarged perspective view of a mounting desk and a driving unit in FIG. 2 assembled together.
Figure 5:
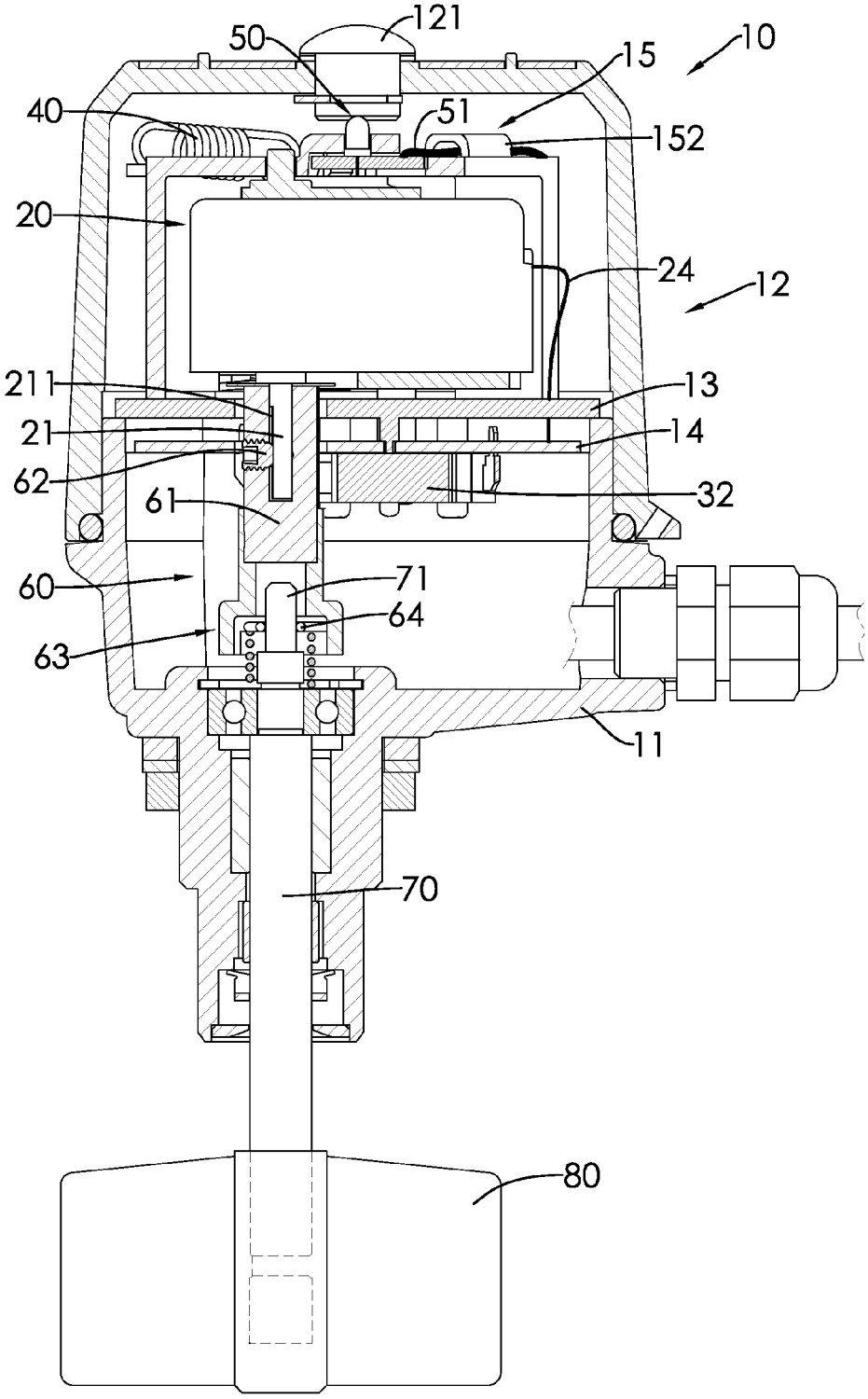
FIG. 5 is a side view in partial section of the rotary paddle level switch in FIG. 1.

With reference to FIGS. 3 to 6, the driving unit 20 is rotatably mounted between the support board 13 and the mounting desk 15, and has multiple electric wires 24, an output member 21, a pressing member 22, and multiple spring holes 23. The electric wires 24 are connected with the driving unit 20, and are connected to the circuit board 14 through the support board 13 as shown in FIGS. 4 and 5. The output member 21 is rotatably mounted in the driving unit 20 and protrudes downwards. The output member 21 is mounted through the support board 13 and the circuit board 14. The driving unit 20 is mounted on the support board 13 with the output member 21 rotatably mounted through the support board 13. The output member 21 has a stop surface 211 formed in a side of the output member 21. The pressing member 22 and the output member 21 are not co-axial. The pressing member 22 is mounted on the bottom of the driving unit 20, is mounted through the first track hole 131 of the support board 13 and the second track hole 141 of the circuit board 14, and is movable within the first track hole 131 and the second track hole 141. The spring holes 23 are formed in a top of the driving unit 20, are aligned in a line with each adjacent two of the spring holes 23 spaced apart from each other by a gap. In the present embodiment, the driving unit is a motor.

Figure 6:
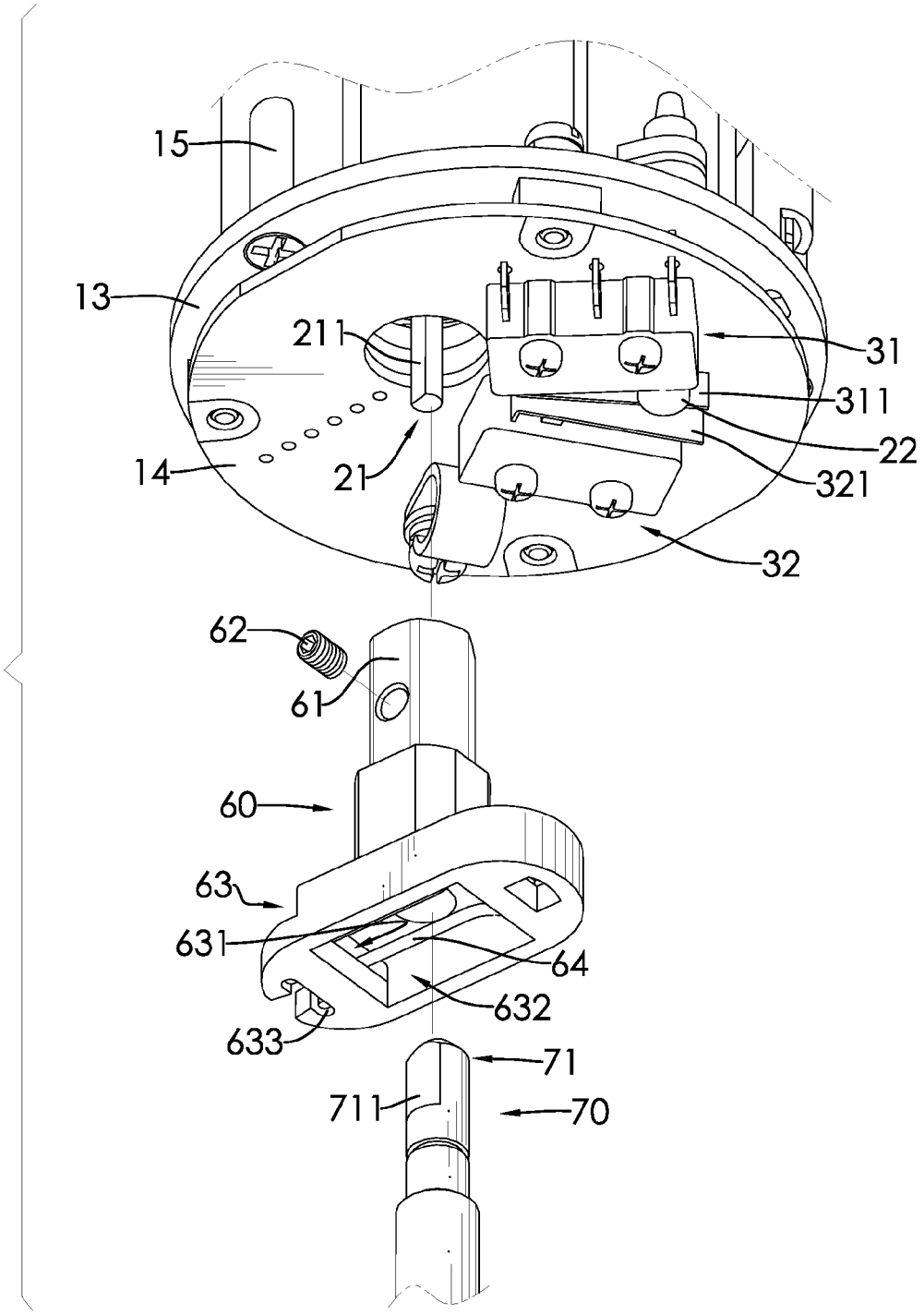
FIG. 6 is a partially enlarged perspective view of a clutch and the driving unit in FIG. 2.
Figure 7:
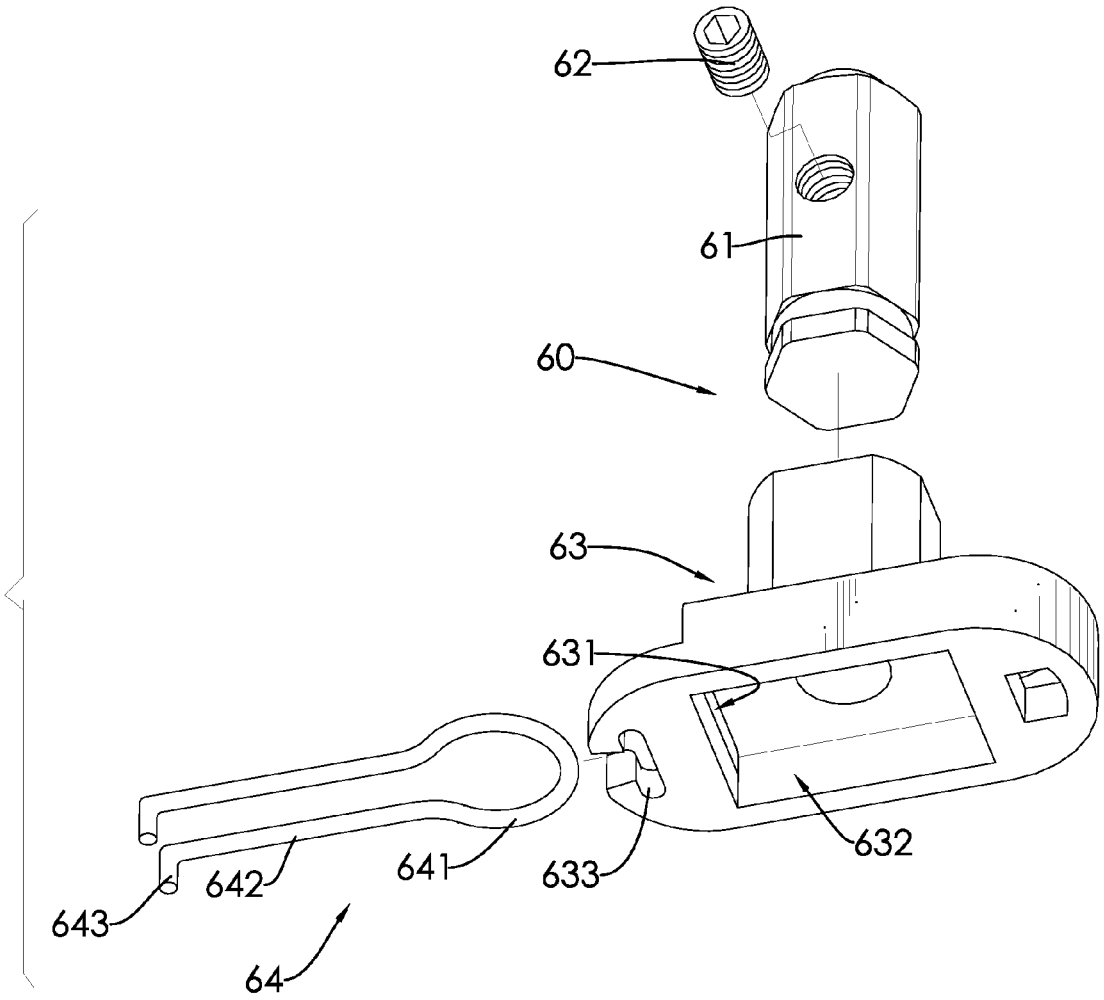
FIG. 7 is an enlarged exploded view of the clutch in FIG. 6.

With reference to FIGS. 3, 5 and 6, the first switch 31 and the second switch 32 are mounted on a bottom of the circuit board 14, are spaced apart from each other by a gap, and are electrically connected to the circuit board 14. The first switch 31 and the second switch 32 respectively have a first actuation part 311 and a second actuation part 321. The first actuation part 311 and the second actuation part 321 are respectively mounted on a side of the first switch 31 and a side of the second switch 32 that face each other. When the first actuation part 311 and the second actuation part 321 are pressed, the first switch 31 and the second switch 32 are turned on. In the present embodiment, the first switch 31 and the second switch 32 are double pole double throw (DPDT) switch. Depending on requirements, the first switch 31 and the second switch 32 may also be optical switch, micro switch, Hall sensor, inductive sensor, and the like.

With reference to FIGS. 2 to 4, the resilient member 40 is mounted inside the housing 10, and is connected between the mounting desk 15 and the driving unit 20. One end of the resilient member 40 is inserted into the insertion hole 151 of the mounting desk 15, and the other end of the resilient member 40 is inserted into one of the spring holes 23 on the driving unit 20, such that the resilient member 40 can pull the driving unit 20 mounted on the support board 13 to abut against the first actuation part 311 of the first switch 31 so as to turn on the first switch 31. The spring holes 23 on the driving unit 20 are provided for the resilient member 40 to be selectively inserted therein according to a desired pulling force of the resilient member 40 for pulling the driving unit 20. In the present embodiment, the resilient member 40 is a tension spring. Given the high sensitivity and torque accuracy, the tension spring can accurately resist torque and move the pressing member at a right time.

With reference to FIGS. 2 to 5, the light-emitting unit 50 is centrally mounted on the top surface of the mounting desk 15, and is located underneath the light-transmitting portion 121 of the top cover. The light-emitting unit 50 has multiple electric wires 51 sequentially mounted through the at least one wire track 152, 153 on the top surface and the side surface of the mounting desk 15, and the support board 13, and connected to the circuit board 14. The light-emitting unit 50 is connected to the second switch 32 through the electric wires 51 and the circuit board 14. Given the at least one wire track 152, 153 mounted through the mounting desk 15, the electric wires 51 can be effectively fixed without moving around.

With reference to FIGS. 2, and 5 to 8, the clutch 60 is mounted in the bottom base 11 of the housing 10, is connected with the driving unit 20, and is driven by the driving unit 20 to rotate. The clutch 60 has a connection member 61, a threaded member 62, a clutch stand 63, and a resilient clip 64. The connection member 61 completely sleeves the output member 21 of the driving unit 20. The threaded member 62 is mounted in the connection member 61 through a screw engagement and abuts against the stop surface 211 of the output member 21 such that the output member 21 can drive the connection member 61 to rotate therewith. The clutch stand 63 partially sleeves the connection member 61, and has a transmission recess 632, a limit hole 633, and a clip opening 631. The transmission recess 632 is formed in a bottom surface of the clutch stand 63. The limit hole 633 is formed through an edge portion of the clutch stand 63, and takes the form of an elongated hole. The clip opening 631 is formed through the edge portion of the clutch stand 63 and an inner wall of the transmission recess 632, and communicates with the limit hole 633 and the transmission recess 632. The resilient clip 64 is made by bending a metal wire, is inserted in the transmission recess 632 through the clip opening 631, and has a curved portion 641, two clipping portions 642, and two limiting portions 643. The curved portion 641 is arc-shaped. The two clipping portions 642 respectively extend from two ends of the curved portion 641, and are parallel to each other. The two limiting portions 643 respectively perpendicularly extend from two outer ends of the clipping portions 642, are parallel to each other, and are inserted into the limit hole 633 to prevent the resilient clip 64 from being easily slipped out of the edge portion of the clutch stand 63.

The transmission shaft 70 is mounted in the bottom base 11 of the housing 10 and is connected with the clutch 60, and has an actuation section 71. The actuation section 71 is formed on a top end of the transmission shaft 70, and has a non-circular section. In the present embodiment, the actuation section 71 has two abutment surfaces 711. The two abutment surfaces 711 are radially and oppositely formed in a periphery of the actuation section 71. The actuation section 71 is mounted through the transmission recess 632 of the clutch stand 63 of the clutch 60, and the two abutment surfaces 711 of the actuation section 71 are respectively held by the two clipping portions 642 of the resilient clip 64. A bottom end of the transmission shaft 70 protrudes downward beyond the housing 10.

With reference to FIGS. 1 and 2, the propeller 80 is mounted on the bottom end of the transmission shaft 70, and is located beyond the housing 10.

When in use, the rotary paddle level switch is fixed in a warehouse, and is electrically connected to a control system.

Figure 8:
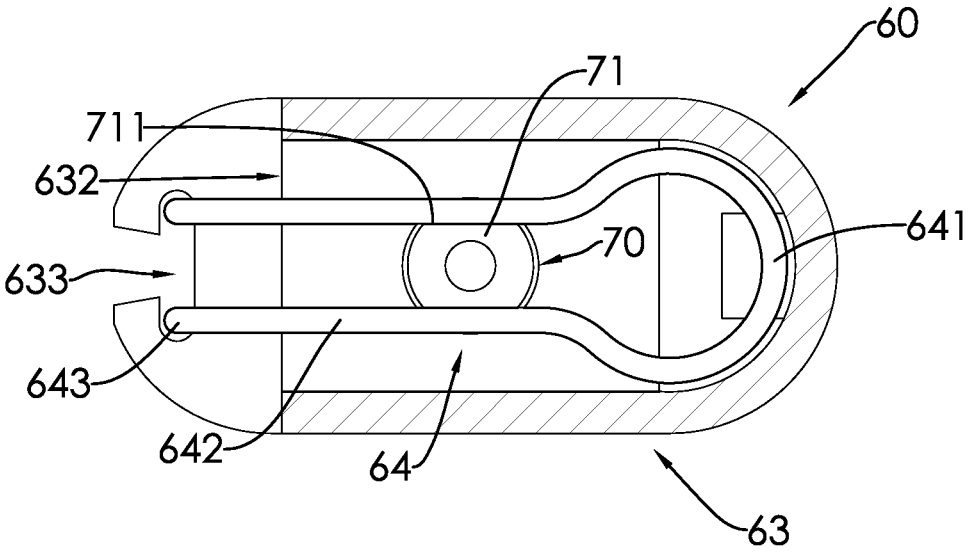
FIG. 8 is an operational top view in partial section of the clutch in FIG. 7.
Figure 9:
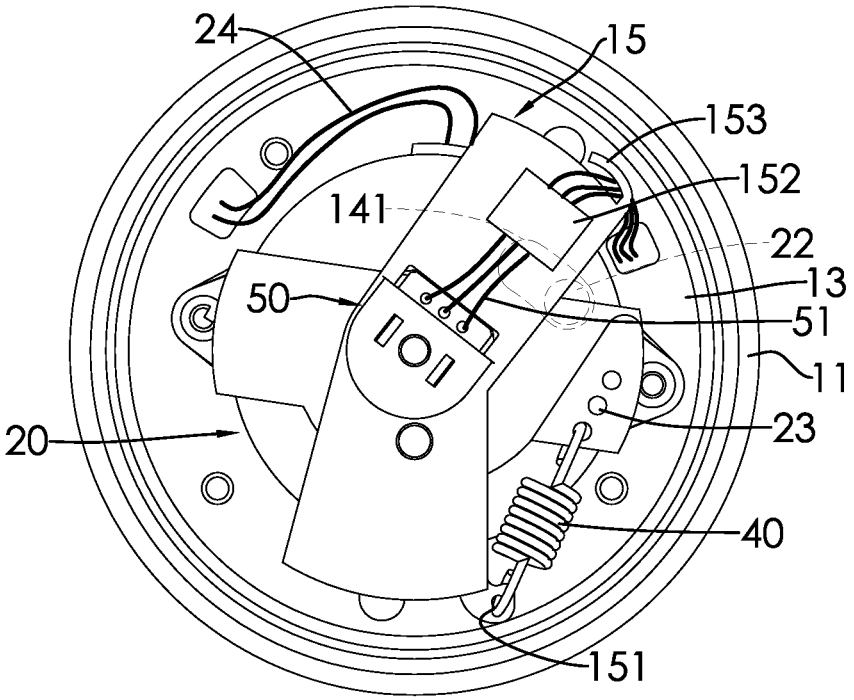
FIG. 9 is an operational top view of the driving unit in FIG. 6.

With reference to FIGS. 2, 8, and 9, when the level of a material stored in the warehouse has not reached the propeller 80 of the rotary paddle level switch, the output portion 21 of the driving unit 20 drives the connection member 61 of the clutch 60 to rotate, the connection member 61 drives the clutch stand 63, the clutch stand 63 drives the resilient clip 64 mounted inside the clutch stand 63 to rotate, and the resilient clip 64 drives the transmission shaft 70 held by the resilient clip 64 and the propeller 80 mounted on the bottom end of the transmission shaft 70 to simultaneously rotate.

Figure 10:
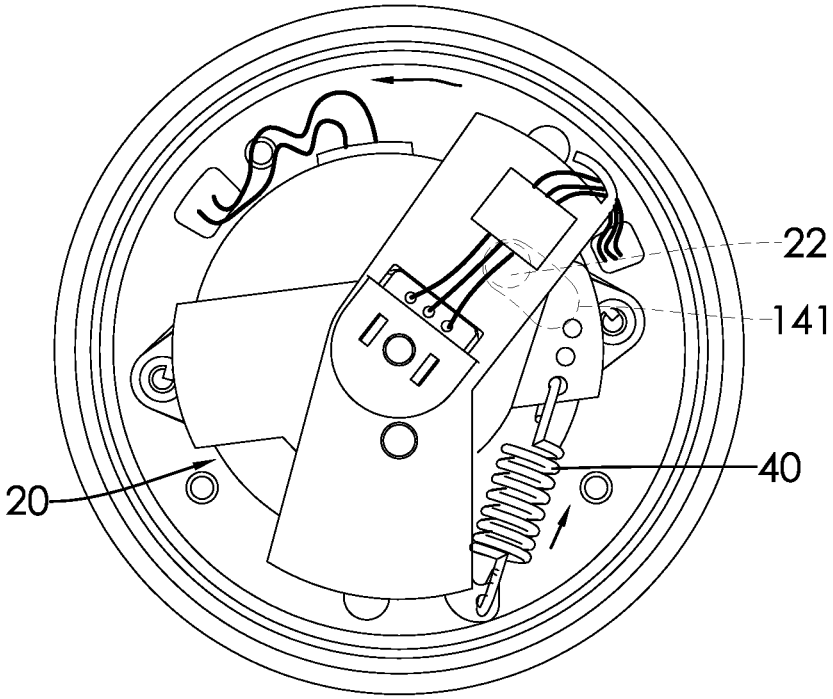
FIG. 10 is another operational top view of the driving unit in FIG. 6.

When the material is piled up and blocks the rotation of the propeller 80, the material becomes a resistance preventing the propeller 80 and the transmission shaft 80 from rotating. The higher the level of the stored material and the larger the resulting contact area with the propeller 80, the more the resistance force is. Finally, the transmission shaft 70 is unable to rotate as a result of the escalating resistance force. With reference to FIGS. 6, 8 and 10, due to the increasing resistance force, the transmission shaft 70 is still held by the resilient clip 64 and fails to be removed from the resilient clip 64 because of the clipping force of the resilient clip 64. Hence, the transmission shaft 70, the clutch 60, and the output member 21 of the driving unit 20 are motionless. Meanwhile, as the driving unit 20 is still in a turn-on condition, the output member 21 of the driving unit 20 must rotate in a direction opposite to the rotation direction of the driving unit 20 and further drives the pressing member 22 to rotate from the first switch 31 to abut against the second actuation part 321 of the second switch 32 so that the driving unit 20 is turned off and a signal is transmitted to the control system to inform that the level of the material has reached a designated height. With reference to FIGS. 1, 2, and 6, when the second actuation part 321 of the second switch is turned on, the light-emitting unit 50 can be also turned on. The light emitted from the light-emitting unit 50 penetrates through the light-transmitting portion of the housing 10 to be visible to users.

Figure 11:
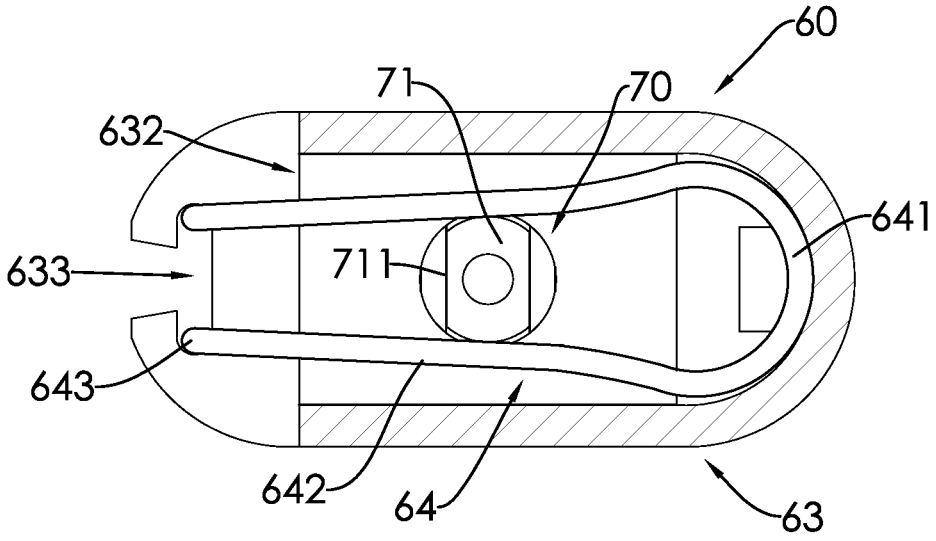
FIG. 11 is another operational top view in partial section of the clutch in FIG. 7.

The foregoing description associates with regular operation of the rotary paddle level switch. With reference to FIGS. 1, 2 and 11, when the material hits the propeller 80 at a particular angle and the propeller 80 together with the transmission shaft 70 suddenly rotate at a high speed, the sudden high rotation speed of the transmission shaft 70 will be released from the holding of the resilient clip 64 so that the transmission shaft 70 is rotated alone without driving the resilient clip 64 to rotate. Accordingly, the sudden high speed will not be transmitted to the driving unit 20 and damage the driving unit 20 to fulfill the purpose of providing the clutch 60.

To achieve the foregoing effectiveness with just the clutch stand 63 and the resilient clip 64, the clutch 60 is advantageous in simple structure and inexpensive cost.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A rotary paddle level switch, comprising:

a housing;

a circuit board mounted inside the housing;

a driving unit rotatably mounted inside the housing, electrically connected to the circuit board, and having a pressing member and an output member, wherein the pressing member and the output member are not coaxial, the pressing member is mounted on a bottom of the driving unit, and the output member is rotatably mounted in the driving unit and protrudes downwards;

a first switch mounted inside the housing and electrically connected to the circuit board;

a second switch mounted inside the housing, electrically connected to the circuit board, and spaced apart from the first switch by a gap;

a resilient member mounted inside the housing, and pulling the driving unit for the pressing member of the driving unit to abut against the first switch;

a transmission shaft mounted in the housing, having an actuation section formed on a top end of the transmission shaft, and having a non-circular section, wherein a bottom end of the transmission shaft protrudes downward beyond the housing;

a clutch mounted inside the housing, connected between the driving unit and the transmission shaft, driven by the driving unit to rotate, and having:

a clutch stand non-relatively rotationally coupled to the output member of the driving unit, and sleeving the actuation section of the transmission shaft; and a resilient clip mounted inside the clutch stand, clipping the actuation section of the transmission shaft, and selectively opened by the actuation section; and a propeller mounted on the transmission shaft, and located outside the housing.

2. The rotary paddle level switch as claimed in claim 1, wherein the resilient clip is made by bending a metal wire, and having:

a curved portion being arc-shaped; and two clipping portions respectively extending from two ends of the curved portion, and being parallel to each other.

3. The rotary paddle level switch as claimed in claim 2, wherein the resilient clip further has two limiting portions respectively vertically extending from two outer ends of the clipping portions, and being parallel to each other.

4. The rotary paddle level switch as claimed in claim 1, wherein the clutch stand has:

a transmission recess formed in a bottom surface of the clutch stand; and a clip opening formed through an edge portion of the clutch stand and an inner wall of the transmission recess, and communicating with the transmission recess;

the resilient clip of the clutch is mounted in the transmission recess of the clutch stand; and the actuation section of the transmission shaft is mounted through the transmission recess of the clutch stand.

5. The rotary paddle level switch as claimed in claim 2, wherein the clutch stand has:

a transmission recess formed in a bottom surface of the clutch stand; and a clip opening formed through an edge portion of the clutch stand and an inner wall of the transmission recess, and communicating with the transmission recess;

the resilient clip of the clutch is mounted in the transmission recess of the clutch stand; and the actuation section of the transmission shaft is mounted through the transmission recess of the clutch stand.

6. The rotary paddle level switch as claimed in claim 3, wherein the clutch stand has:

a transmission recess formed in a bottom surface of the clutch stand;

a clip opening formed through an edge portion of the clutch stand and an inner wall of the transmission recess, and communicating with the transmission recess; and a limit hole vertically formed through the edge portion of the clutch stand;

the resilient clip of the clutch is mounted in the transmission recess of the clutch stand and the two limiting portions of the resilient clip are inserted into the limit hole; and the actuation section of the transmission shaft is mounted through the transmission recess of the clutch stand.

7. The rotary paddle level switch as claimed in claim 1, wherein the actuation section of the transmission shaft has two abutment surfaces radially and oppositely formed in a periphery of the actuation section.

8. The rotary paddle level switch as claimed in claim 1, wherein the resilient member is a tension spring.

9. The rotary paddle level switch as claimed in claim 7, wherein the resilient member is a tension spring.

10. The rotary paddle level switch as claimed in claim 1, wherein the housing further has:

a support board mounted inside the housing; and a mounting desk mounted inside the housing, and mounted on a top of the support board;

the driving unit is pivotally mounted between the support board and the mounting desk; and two ends of the resilient member are respectively connected to the mounting desk and the driving unit.

11. The rotary paddle level switch as claimed in claim 9, wherein the housing further has:

a support board mounted inside the housing; and a mounting desk mounted inside the housing, and mounted on a top of the support board;

the driving unit is pivotally mounted between the support board and the mounting desk; and two ends of the resilient member are respectively connected to the mounting desk and the driving unit.

12. The rotary paddle level switch as claimed in claim 10, wherein the support board has a first track hole formed through the support board;

the circuit board is mounted on a bottom of the support board, and has a second track hole formed through the circuit board;

the first switch and the second switch are mounted on a bottom of the circuit board; and the pressing member of the driving unit is mounted through the first track hole of the support board and the second track hole of the circuit board.

13. The rotary paddle level switch as claimed in claim 11, wherein the support board has a first track hole formed through the support board;

the circuit board is mounted on a bottom of the support board, and has a second track hole formed through the circuit board;

the first switch and the second switch are mounted on a bottom of the circuit board; and the pressing member of the driving unit is mounted through the first track hole of the support board and the second track hole of the circuit board.

14. The rotary paddle level switch as claimed in claim 10, wherein the driving unit has multiple spring holes formed in a top of the driving unit; and one end of the resilient member is inserted in one of the spring holes of the driving unit.

15. The rotary paddle level switch as claimed in claim 13, wherein the driving unit has multiple spring holes formed in a top of the driving unit; and one end of the resilient member is inserted in one of the spring holes of the driving unit.

16. The rotary paddle level switch as claimed in claim 1, further comprising a light-emitting unit connected with the housing and electrically connected to the circuit board.

17. The rotary paddle level switch as claimed in claim 15, further comprising a light-emitting unit connected with the housing and electrically connected to the circuit board.

18. The rotary paddle level switch as claimed in claim 16, wherein the housing further has a light-transmitting portion mounted on the housing; and the light-emitting unit is mounted inside the housing to align with the light-transmitting portion of the housing.

19. The rotary paddle level switch as claimed in claim 17, wherein the housing further has a light-transmitting portion mounted on the housing; and the light-emitting unit is mounted inside the housing to align with the light-transmitting portion of the housing.

20. The rotary paddle level switch as claimed in claim 19, wherein the mounting desk has at least one wire track mounted on a periphery of the mounting desk; and the light-emitting unit is mounted on a top surface of the mounting desk, and has at least one electric wire connected with the light-emitting unit, wherein each of the at least one electric wire is mounted through the at least one wire track and is connected to the circuit board.

* * * * *